United States Patent [19]

Kim

[11] Patent Number: 4,862,909

[45] Date of Patent: Sep. 5, 1989

[54] DRAINAGE PAN FOR LIQUID WASTE CONTAINERS

[76] Inventor: Il Y. Kim, 7953 Audubon Ave., B-7, Alexandria, Va. 22306

[21] Appl. No.: 317,839

[22] Filed: Mar. 3, 1989

[51] Int. Cl.[4] ..... F04B 45/02; F04F 10/00

[52] U.S. Cl. ..... 137/150; 137/312; 220/1 C; 220/69; 222/108

[58] Field of Search ..... 137/147, 150, 312, 565; 220/1 C, 23.83, 23.86, 69, 85 H, 85 S, 108, 109, 289, 287, 291; 62/289, 291

[56] References Cited

U.S. PATENT DOCUMENTS

| | | | |
|---|---|---|---|
| 957,566 | 5/1910 | Knickerbocker | 137/150 |
| 3,069,671 | 12/1962 | Taylor | 137/312 |
| 3,674,381 | 7/1972 | Schiff | 417/234 |
| 4,552,515 | 11/1985 | Endo | 137/150 |
| 4,748,821 | 6/1988 | Berenter | 62/289 |
| 4,765,360 | 8/1988 | Baird | 137/312 |

FOREIGN PATENT DOCUMENTS

| | | | |
|---|---|---|---|
| 185000 | 9/1985 | Japan | 137/150 |
| 7510537 | 3/1977 | Netherlands | 126/363 |

*Primary Examiner*—George L. Walton
*Attorney, Agent, or Firm*—Birch, Stewart, Kolasch & Birch

[57] ABSTRACT

A drainage pan for liquid waste containers which includes a Z-bar suction pump assembled with the wall thereof for draining the liquid waste leaked from a liquid waste container, an overflow drain pipe disposed at the upper portion of the wall thereof for draining liquid waste overflow leaked from the liquid waste container, and a plurality of gradually declining supports disposed on the bottom thereof for supporting a liquid waste container whereby the drainage pan prevents the liquid waste from contaminating humans or the ground.

7 Claims, 2 Drawing Sheets

DRAINAGE PAN FOR LIQUID WASTE CONTAINERS

BACKGROUND OF THE INVENTION

1. Field of the Invention

The present invention relates to a drainage pan for liquid waste containers and more particularly, to a drainage pan including a Z-bar suction pump for draining liquid waste leaked from the liquid waste container into a drainage pipe so as to prevent the liquid waste from harming humans, animals, plants, and the like and from contaminating to the ground.

2. Field of the Prior Art

Several types of drainage pans are known in the art and have a plurality of depressions therein. However, such drainage pans require a type of dipper for dipping the liquid waste collected in the depressions of the drainage pans. Therefore, it is possible for a hand to contact the liquid waste and also it is necessary to prepare a storage container for collecting the liquid waste from the dipper. Also, such drainage pans have proven to be unpractical for various purposes since such drainage pans cause contamination of the ground during the operation of draining the liquid waste.

SUMMARY OF THE INVENTION

Accordingly, it is an object of the present invention to provide an improved drainage pan for liquid waste containers.

Another object of the present invention is to provide a drainage pan including a Z-bar suction pump for draining liquid waste that leaks from a liquid waste container into a drainage pipe directly so as to prevent the liquid waste to be harmful to the human, animals, plants, and the like from contaminating to the ground.

A further object of the present invention is to provide a drainage pan having an overflow drain pipe disposed at the upper portion of the wall thereof for preventing the liquid waste from overflowing therefrom.

Yet another object of the present invention is to provide a drainage pan including a plurality of gradually declining supports disposed on the bottom thereof for supporting a liquid waste container.

Still another object of the present invention is to provide a drainage pan that is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a drainage pan for liquid waste containers which comprises a Z-bar suction pump assembled on the wall thereof for draining liquid waste that is leaked from the liquid waste container, an overflow drain pipe disposed at the upper portion of the wall thereof for draining the liquid waste overflow that is leaked from the liquid waste container, and a plurality of gradually declining supports disposed on the bottom thereof for supporting the liquid waste container whereby the drainage pan prevents the liquid waste from contaminating to the ground.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
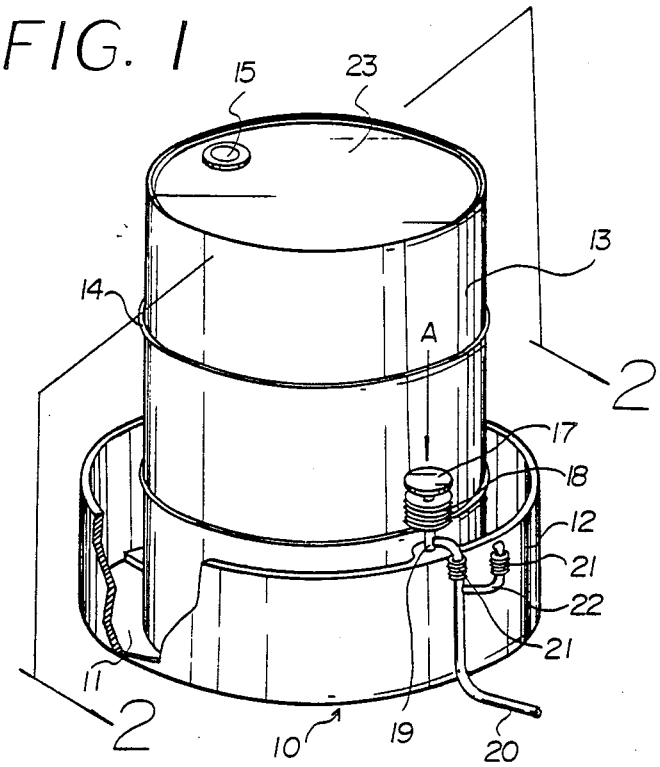
FIG. 1 is a perspective view of a drainage pan containing a liquid waste container according to the present invention.
Figure 2:
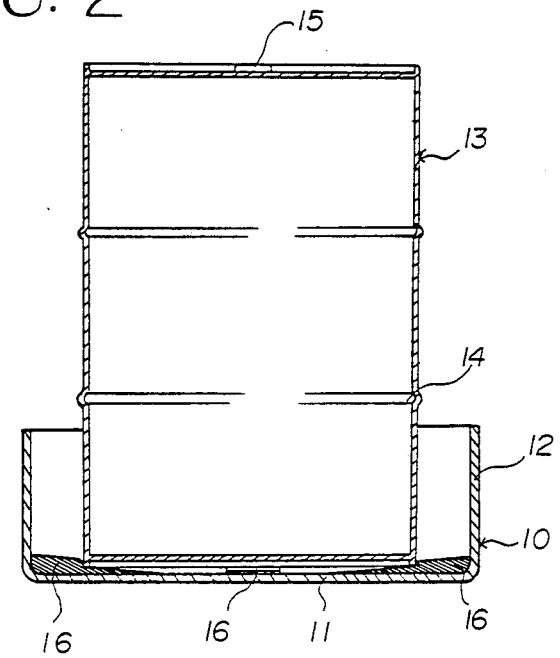
FIG. 2 is a sectional view of FIG. 1, taken along line 2—2.
Figure 3:
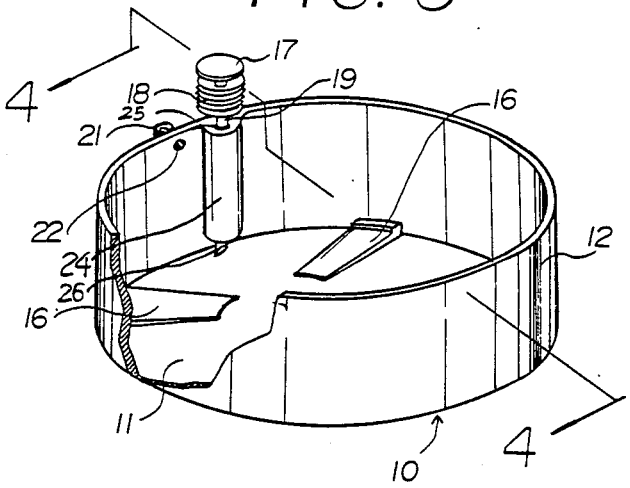
FIG. 3 is a perspective vie of a drainage pan showing a z-bar suction pump assembled therewith according to the present invention.

Referring now in detail to the drawings for the purpose of illustrating preferred embodiments of the present invention, a drainage pan 10 as shown in FIGS. 1 and 3 includes a circular bottom 11 and a wall 12 for easily receiving a liquid waste container 13. A Z-bar suction pump 18 is assembled on the wall 12 of the drain pan 10. A plurality of gradually declining supports 16 are located on the circular bottom 11 of the drain pan 10. The liquid waste container 13 includes a plurality of rims 14 disposed on the wall surface and an opening 15 disposed on a lid 23 thereof (FIG. 2).

Figure 4:
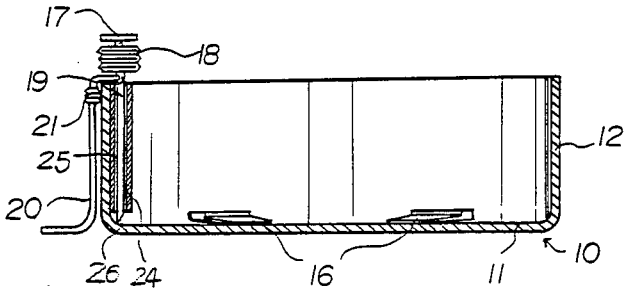
FIG. 4 is a sectional view of FIG. 3, taken along line 4—4.

The Z-bar suction pump 18 is provided with a push plate 17 disposed thereon, a suction pipe 19 connected thereto, and a drain pipe 20 connected to the suction pipe. The suction pipe 19 includes a diagonally cut end opening 26 thereof for completely taking in the liquid waste. The suction pipe 19 also can include valve members (not shown) which are opened and closed in accordance with the sucking and discharging of liquid waste. As shown in FIGS. 3 and 4, the suction pipe 19 is slidably engaged in an aperture 25 disposed in a raised portion 24 which extends from the wall 12. An overflow drain pipe 22 connected to the drain pipe 20 at the one end is located in the upper portion of the wall 12 adjacent to the suction pump 18 for preventing the liquid waste from overflow leaking from the drain pan 10. The drain pipe 20 and overflow drain pipe 22 each have a tensible portion 21, respectively for being easily bent. In operation, when a liquid waste container 13 such as a drum filled with a sulfuric acid is put in the drainage pan 10, if liquid waste such as the sulfuric acid leaks through the opening 15 of the lid 23 of the container 13, the liquid waste is collected at some volume in the bottom 11 of the drainage pan 10 (FIGS. 1 and 2). At this time, when the push plate 17 is repeatedly pushed by foot as indicated by arrow (A) as shown in FIG. 1, the liquid waste such as the sulfuric acid in the drain pan 10 is drained by being sucked into the drain pipe 20 through the end opening 26 of the suction pipe 19. If the liquid waste fills in the drainage pan 10, when the suction pump does not operate, the overflow liquid waste above the overflow drain pipe 22 is automatically drained through the overflow drain pipe 22 into the drain pipe 20. Generally, the drain pipe 20 may be connected to a connecting means for delivering the liquid waste into a waste disposal area (not shown).

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A drainage pan assembly for a liquid waste container which comprises a drainage pan body including a bottom and a wall for receiving said liquid waste container, said wall being provided with a receptacle extending therefrom, a manually operated suction pump connected to a suction pipe and a drain pipe connected to said suction pipe, said suction pipe being removably insertable within said receptacle so that it extends into close proximity to the bottom of the drainage pan, an aperture disposed in the top wall portion of said drainage pan body, and an overflow conduit connected to said aperture and said drain pipe so that said overflow conduit provides continuous drainage through said aperture exterior of the drainage pan whether or not the pump is operative, wherein said drainage pan collects liquid waste which leaks from the liquid waste container and said liquid waste is easily removed by operating the suction pump.

2. The drainage pan of claim 1, wherein the receptacle contains an aperture and the suction pipe connected to the suction pump is slidably engaged in said aperture.

3. The drainage pan of claim 2, wherein the suction pipe has a diagonally cut end portion to facilitate the complete removal of the liquid waste collected in the drainage pan body.

4. The drainage pan of claim 1, wherein the suction pump has a push plate disposed thereon for said manual operation.

5. The drainage pan of claim 1, wherein the drain pipe and the overflow conduit each have a flexible portion, whereby the position of the drain pipe can be readily adjusted.

6. The drainage pan of claim 1, wherein the receptacle extends from the wall into the interior of the drainage pan.

7. The drainage pan of claim 1 wherein a plurality of inclined supports are disposed in the bottom of the drain pan body for supporting the liquid waste container.

* * * * *